United States Patent [19]

Lorenz et al.

[11] Patent Number: 4,647,341

[45] Date of Patent: Mar. 3, 1987

[54] DRY COKE COOLING PLANT

[75] Inventors: Kurt Lorenz, Hattingen; Horst Dungs, Herne; Gerd Nashan, Oberhausen; Dieter Breidenbach, Waltrop; Josef Volmari, Bochum, all of Fed. Rep. of Germany

[73] Assignee: Firma Carl Still GmbH & Co.KG, Fed. Rep. of Germany

[21] Appl. No.: 683,934

[22] Filed: Dec. 20, 1984

[30] Foreign Application Priority Data

Dec. 23, 1983 [DE] Fed. Rep. of Germany ..... 3346620

[51] Int. Cl.[4] ..... C10B 39/02

[52] U.S. Cl. ..... 202/228; 201/39; 202/253

[58] Field of Search ..... 202/95, 227, 228, 253, 202/261; 201/39; 110/259, 69; 414/216; 34/172; 65/134.1; 432/123, 127, 243, 232, 233, 234

[56] References Cited

U.S. PATENT DOCUMENTS

| | | | |
|---|---|---|---|
| 1,917,746 | 1/1932 | West | 414/216 |
| 4,338,161 | 7/1982 | Weber et al. | 202/228 |
| 4,391,587 | 7/1983 | Murakami et al. | 432/121 |
| 4,588,479 | 5/1986 | Weber et al. | 202/228 |

OTHER PUBLICATIONS

"Kokstrockenkühlung mit Kühlwänden im Koksschacht", Van H. Dungs, Technische Mitteilungen vol. 75, No. 9, 1982, pp. 434–439.

*Primary Examiner*—Jan Silbaugh
*Assistant Examiner*—Jennifer Cabaniss
*Attorney, Agent, or Firm*—McGlew and Tuttle

[57] ABSTRACT

A dry coke cooling apparatus comprises an antechamber with a bottom hole for charging coke into a cooling chamber which accommodates vertical outer cooling walls and inner cooling walls which extend within the coke charge. The lower part accommodates coke discharge equipment and conduits for supplying circulated cooling gas which passes upwardly through the charge, to be exhausted at the top. The inner cooling walls are supported on hollow beams which are cooled by the circulated cooling gas directly or indirectly.

5 Claims, 2 Drawing Figures

DRY COKE COOLING PLANT

FIELD AND BACKGROUND OF THE INVENTION

This invention relates in general to coke treating devices and in particular to a new and useful dry coke cooler in which the cooling walls of the cooler are supported on hollow beams which are cooled by the cooling gases.

A plant of this kind is described in the German periodical "Technische Mitteilungen", (Technical Reports) vol. 75, No. 9 1982, pages 434 to 439. FIGS. 2 on page 435 of the publication shows that the cooling walls are supported on a beam which extends transversely to the cooling walls and is fixed to the outer walls of the cooling chamber. In view of the large size of the cooling chamber, and their regularly wide span, these beams must be amply dimensioned. In addition, experience has shown that minimizing the cooling gas amount easily raises the temperature of these beams to levels endangering the strength of the beams.

Further known again from FIG. 2 on page 435 of the above reference, are tipping dischargers by means of which cooled coke is removed in metered amounts at the bottom of the cooling space. These dischargers are about 3 meters long and are actuated by hydraulic cylinders mounted outside the cooling space, and they extend over half the length of the space. Intermediate the dischargers, an inspection passage is provided for maintaining and repairing the discharger bearings. This passage requires relatively much space and the cooled coke must flow therearound, which may cause distribution problems.

SUMMARY OF THE INVENTION

The invention is directed to an improved support of the cooling walls and the tipping dischargers in the cooling chamber, resulting in a further reduction of the circulated gas amount, and a more uniform discharge of the coke.

In accordance with the invention, a dry coke cooler comprises a vessel which has an upper coke charge receiving portion in the form of an antechamber which has a lower discharger which discharges into a lower cooling chamber until the coke accumulates into substantially the upper end of the cooling chamber. A plurality of substantially vertical cooling walls which are spaced apart extend across the cooling chamber and they are adapted to extend within the coke charge. At least one hollow beam extends below the cooling walls and supports the walls either directly or through intermediate T-beams or eye beams positioned therebetween. The cooling chamber has an outlet for the cooling gases at the upper end and an inlet for the cooling gas directed into the cooling chamber in the vicinity of the hollow beams and advantageously through the hollow beam for discharge for openings at the lower end of the beam for upward flow through the cooling chamber.

Accordingly, it is an object of the invention to provide an improved dry coke cooler which includes a cooling chamber having vertical cooling walls which are supported on hollow beams which are cooled by the cooling gas flow.

The invention idea is to support the cooling walls in the cooling chamber with beams which are hollow, and thus to simplify this support due to the obtained possibility of cooling these beams and thus keeping them permanently at low temperatures.

A higher temperature of the coke can then be allowed in the zone of the hollow beams and, consequently, the inner cooling walls can be extended downwardly by a considerable length, as compared to prior art designs, whereby the heat amount transferred through the inner cooling walls to the circulated coolant is considerably augmented and the amount of circulating gas can be reduced. It has been found that even with such a reduction of cooling gas amounts, surprisingly, the temperature of the coke leaving the cooling chamber, for example at locations adjacent the dischargers, changes insignificantly.

It has further been found advisable to dimension the coke cooling apparatus in a way such as to have the hollow beams disposed in a zone where the coke has temperatures between about 200° C. and 300° C. Within this temperature zone, especially with an inner cooling of the hollow beams, the strength of the hollow beams is not endangered.

In view of the optimum distribution of the cooling gas over the entire length of the cooling chamber, it has proved advantageous to provide within the hollow beams another duct for supplying the cooling gas, which tapers in the flow direction toward its end.

A differnce in levels between the hollow beams supplying cooling gas and the lower edge of the cooling walls may be bridged, in accordance with the invention, by providing additional beams or supports extending in the longitudinal direction of each individual cooling wall, between the hollow beams and the cooling walls proper. More particularly, these additional beams or supports may be provided beneath the coke deflecting sheets of the coke chutes, so that they are entirely protected from being mechanically loaded by the coke and the coke can be discharged through the chute without any obstacle.

In a development of the invention the support of the bearings of the tipping dischargers in the lower part of the cooling chamber is improved. According to this development, the dischargers are mounted in the central zone of the cooling chamber on a narrow beam which extends parallel to the cooling walls, transversely through the entire cooling chamber. An inspection passage in the central zone of the cooling chamber, for maintaining and repairing the discharger bearings, is omitted, and the inner bearings of the dischargers are designed as dry running high-temperature bearings requiring no maintenance. With this design, only a small cover sheet need be provided above the high-temperature bearings, to direct the coke flow. This deflects the coke in the zone of the chutes much less than with the prior art design of an inspection passage, so that the discharge is smoother. It has further proved advantageous to dispose the row of the inner high temperature bearings on the narrow beam exactly in the central zone of the cooling chamber below a central cooling wall. This necessarily requires an odd number of inner cooling walls, instead of an even number as before. This again assists the undisturbed discharge of the coke in the central zone, without larger deflections.

A further object of the invention is to provide a dry coke cooler which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
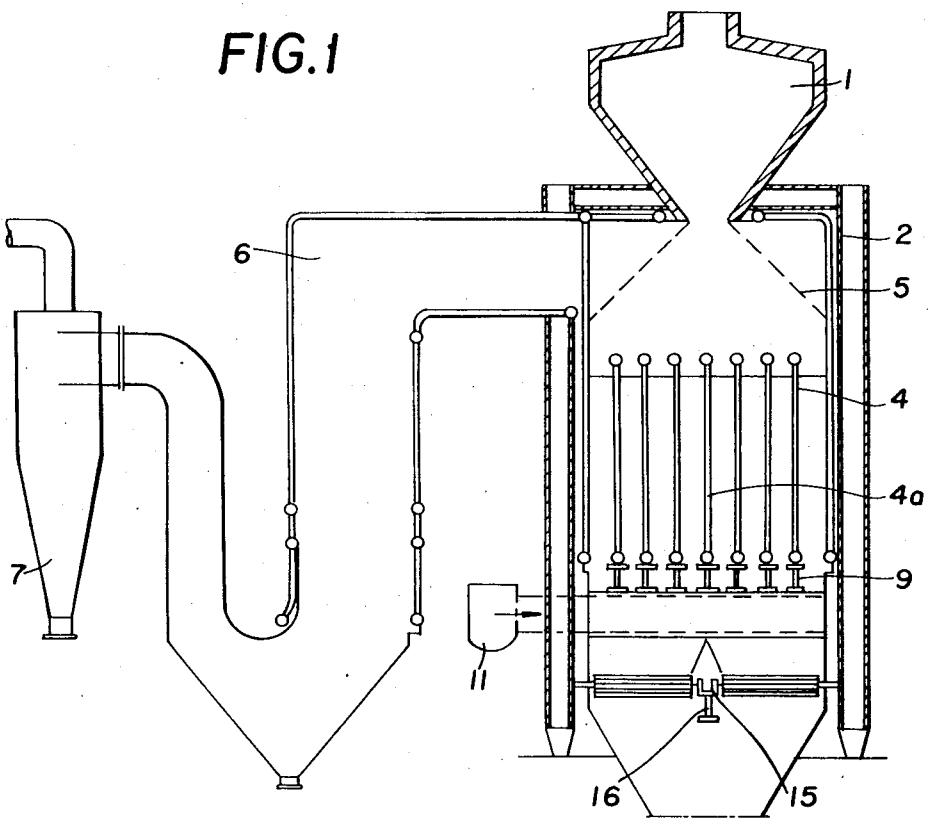
FIG. 1 is a vertical sectional view of a dry coke cooling plant constructed in accordance with the invention.

Referring to the drawings in particular the invention embodied therein comprises a coke cooler which includes a vessel having an upper coke charge receiving portion or antechamber 1 and a lower cooling chamber 2 disposed below the charge receiving portion in a position to receive a charge of coke therein discharged for example to a level indicated in dotted oblique lines as a charging cone 5 in FIG. 1.

Figure 2:
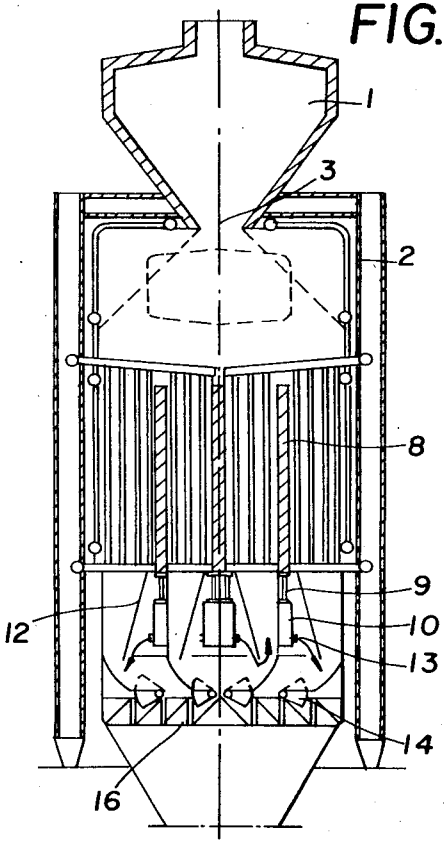
FIG. 2 is a corresponding sectional view in the direction perpendicular thereto.

In accordance with the invention, a plurality of substantially vertical cooling walls 4, 4*a* which are spaced apart extend across the cooling chamber and are adapted to extend within the coke charge. At least one hollow beam 10 or three such beams as indicated in FIG. 2 extend through the lower portion of the cooling chamber below the cooling walls and they provide means for supporting the cooling walls through intermediate walls 8 and support beams 9. An outlet for the cooling gases at the upper end of the cooling chamber 2 leads to a waste heat boiler 6. The cooling gases are directed inwardly into the cooling chamber through a conduit 11. These gases first pass into and along the hollow beams 10 and may in fact cool beam 10. The gases then flow to an outlet 13 which is indicated in each of the beams 10 and upwardly through the coke charge to the discharge which connects through the waste heat boiler 6.

In the coke cooling process, hot coke is directed through an antechamber 1 and a charge hole 3 thereof into a cooling chamber 2 having inner cooling walls 4. The coke is removed from the cooling chamber at the bottom through coke chutes 12 and tipping dischargers 14. The circulated cooling gas is supplied through a conduit 11 and, at the lower end of the coke chutes 12, through outlets 13 of horizontal ducts designed as hollow beams 10 and into the cooling chamber as shown by the arrows where it flows, upwardly to leave the chamber at the upper end thereof, outside the coke charge cone 5. The cooling gas then flows to a waste heat boiler 6 and a following fine dust separator 7, which, with the interposition of some further equipment, is connected to the supply conduit 11. Chutes 12 form coke charge-free spaces for the support and hollow beams 9, 10 which spaces are downwardly open.

Below the individual cooling walls 4, 4*a*, spaced-apart supports or beams 9 are provided, which are secured to the hollow beams 10 extending therebeneath. The space between the deflecting sheets of the coke chutes and the hollow beams 10 may be substantially filled with an insulating material, but it may also be cooled by the incoming cooling gas. The cooling walls 4 in cooling chamber 2 are provided in an odd number, to position the central wall 4*a* at the center of the chamber. The central wall bears through one of the supports 9 against a hollow beam 10. Exactly vertically below the central cooling wall 4*a*, a bearing beam 16 extends in the same direction, on which the inner high temperature bearings 15 of dipping dischargers are mounted.

The coke which gradually flows downwardly through the two compartments formed adjacent the inner cooling wall 4*a*, is only insignificantly deflected in the zone of the coke chutes 12 by the sheet covering of the high temperature bearings 15. Therefore, the coke discharge is no longer retarded above these inner bearings.

While a specific embodiment of the invention has been shown and described in detail to illustrate the application of the principles of the invention, it will be understood that the invention may be embodied otherwise without departing from such principles.

What is claimed is:

1. A dry coke cooler comprising a vessel having an upper coke charge receiving portion and a lower cooling chamber disposed therebelow in a position to receive a charge of coke therein, a plurality of substantially vertical cooling walls which are spaced apart and extend across said cooling chamber and are adapted to extend within the coke charge, at least one hollow beam extending below said cooling walls and supporting said walls, a chamber outlet for cooling gas adjacent the top of said cooling chamber, a chamber inlet for cooling gases extending into said cooling chamber and connected to said hollow beam for flow of cooling gases into said hollow beam, said hollow beam having at least one beam outlet for flow of the cooling gases upwardly through the coke charge and through said chamber outlet, a support beam positioned between said hollow beam and said cooling walls, and deflecting sheets adjacent a lower end of said cooling chamber for deflecting the coke charge away from said support beam and away from said hollow beam, said sheets defining a downwardly open coke charge-free space fully containing said support beam, said hollow beam and said beam outlet of said hollow beam.

2. A dry coke cooler according to claim 1, wherein said hollow beam has an upper side on which said support beam is supported, said dry coke cooler including an intermediate wall supported on said support beam and carrying said plurality of cooling walls.

3. A dry coke cooler according to claim 2, wherein there are a plurality of hollow beams each of which provides a passage for the cooling gases.

4. A dry cooler according to claim 3, including a coke removal system adjacent to the lower end of said cooling chamber comprising a plurality of tipping discharge members exending across a portion of said cooling chamber and each having a tipping axis extending parallel to said hollow beams, said cooling chamber having a plurality of coke discharges at its lower end each for receiving one of said tipping discharge members, said coke discharges and said tipping discharge members each being disposed below said hollow beams and below said deflecting sheets, a bearing beam near a center of the lower end of said cooling chamber for rotatably carrying said tipping axis of two of said tipping discharge members.

5. A dry cooler according to claim 4 wherein said bearing beam includes a central bearing for each of said two tipping axes, each bearing beam being disposed below said hollow beams and being made of temperature resistant low-maintenance material, said bearing beam extending across the center of said cooling chamber at said lower end of said cooling chamber below said hollow beams.

* * * * *